US005311965A

United States Patent [19]

Wu

[11] Patent Number: 5,311,965

[45] Date of Patent: May 17, 1994

[54] AUTO LIFE-SAVING LADDER

[76] Inventor: Hsien-Jung Wu, No. 36, Sec. 1, Jong Shan Rd., Yeong Her, Taipei, Taiwan

[21] Appl. No.: 62,760

[22] Filed: May 18, 1993

[51] Int. Cl.[5] ..... A62B 3/00

[52] U.S. Cl. ..... 182/85; 182/95; 182/74

[58] Field of Search ..... 182/85, 86, 93, 95, 182/97, 77, 78, 75, 74

[56] References Cited

U.S. PATENT DOCUMENTS

| | | | |
|---|---|---|---|
| 169,096 | 10/1875 | Garrick | 182/86 |
| 502,070 | 7/1893 | Fairchild | 182/85 X |
| 2,905,261 | 9/1959 | McConologue | 182/95 X |
| 3,180,451 | 4/1965 | Patterson | 182/85 X |
| 3,386,531 | 6/1968 | Sallein | 182/85 X |

*Primary Examiner*—Alvin C. Chin-Shue

*Attorney, Agent, or Firm*—Bacon & Thomas

[57] ABSTRACT

A movable type staircase is disclosed, particularly one which is located at the exterior wall or veranda at various floor levels of a building. In an emergency, a safety bar on any floor may be pushed aside to enable the movable staircase to unfold itself and connect rapidly by its own gravity with the veranda or fire exit at a lower floor level. Also by means of the force produced when the movable type staircase is being lowered, a safety bar at the next lower floor level will be further pushed aside to again enable that movable staircase to unfold itself and rapidly connect by its own gravity with still another lower floor level and so on until the various floor levels which are lower than the floor which the user is staying can be connected automatically in a way similar to an indoor staircase. It is a staircase which provides a highly safe and automatic means of escape for people in time of emergency.

4 Claims, 6 Drawing Sheets

AUTO LIFE-SAVING LADDER

BACKGROUND OF THE INVENTION

With the development of modern technology, high buildings are erected to provide people with a more comfortable living environment. Various new models of life-saving apparatus are available to cope with and satisfy new requirements derived from the modern life style in high buildings, among which a suspension type of slow descending life saving equipment is very popular and marketable. It comprises three gears, one gear ring and other assembling members. It is made of a centrifugal structure with the application of centrifugal theory, and resistance will be produced by the gears in coordination with the gear ring and the other assembling members to reduce the descending speed of people being suspended on it, so as to achieve the object of saving their own life. However, in spite or providing people with a light and convenient means of escape, such suspension life-saving equipment will make people face danger and feel afraid when they are being suspended on a steel wire facing the exterior wall of a tall building. Its capacity is also found to be extremely small due to its limitation of allowing one person to escape at a time.

Focussing on the defects of a suspension type slow descending life saving equipment described above, the inventor devoted himself to years of research and study for necessary renovation, and managed to overcome the aforesaid defects with the present invention hereof.

SUMMARY OF THE INVENTION

The present invention relates to a movable type staircase, particularly one which is located at the exterior wall or veranda at various floor levels of a building. In an emergency, its safety bar on any floor may be pushed aside to enable the movable staircase to unfold itself and connect rapidly by its own gravity with the veranda or fire exit at a lower floor level. Also by means of the force produced when the movable type staircase is being lowered, the safety bar at the next lower floor level will be further pushed aside to again enable that movable staircase to unfold itself and rapidly connect by its own gravity with still another lower floor level and so on until the various floor levels which are lower than the floor which the user is staying can be connected automatically in a way similar to an indoor staircase. It is a staircase which provides a highly safe and automatic means of escape for people in time of emergency.

In the "Auto Life-Saving Ladder" described hereof, a movable type staircase will be set on a life-saving veranda which is set beforehand or on an existing veranda at the external wall of a building. A steel wire is connected to the guardrailing at each of the two sides of the movable staircase winding around the outside diameter of the same rewinding wheel, onto one end of which a safety bar is set to restrain the movable staircase from being loosened at normal times. On the contrary, the safety bar can be pushed aside in an emergency to enable the movable staircase to drop downward by its own gravity to touch and push aside the safety bar at the lower floor level. In this way, the pushing aside of safety bars in a downward floor by floor movement enables the staircase of each floor to connect together into a series of staircases similar to those found in indoor safety staircase, to the ultimate effect of providing a safety staircase which is highly safe and convenient for many people to escape without causing fear.

A rotating gear is set on another end of the rewinding wheel which, by means of using another idle wheel as the middle wheel in engagement with the rotating gear of the speed reducing motor, will automatically fold up the movable type staircase or making use of the direct engagement of the idle wheel with the rewinding wheel to fold the movable staircase manually to achieve the secondary object of using the movable staircase repeatedly.

DETAILED DESCRIPTION OF THE INVENTION

Figure 4:
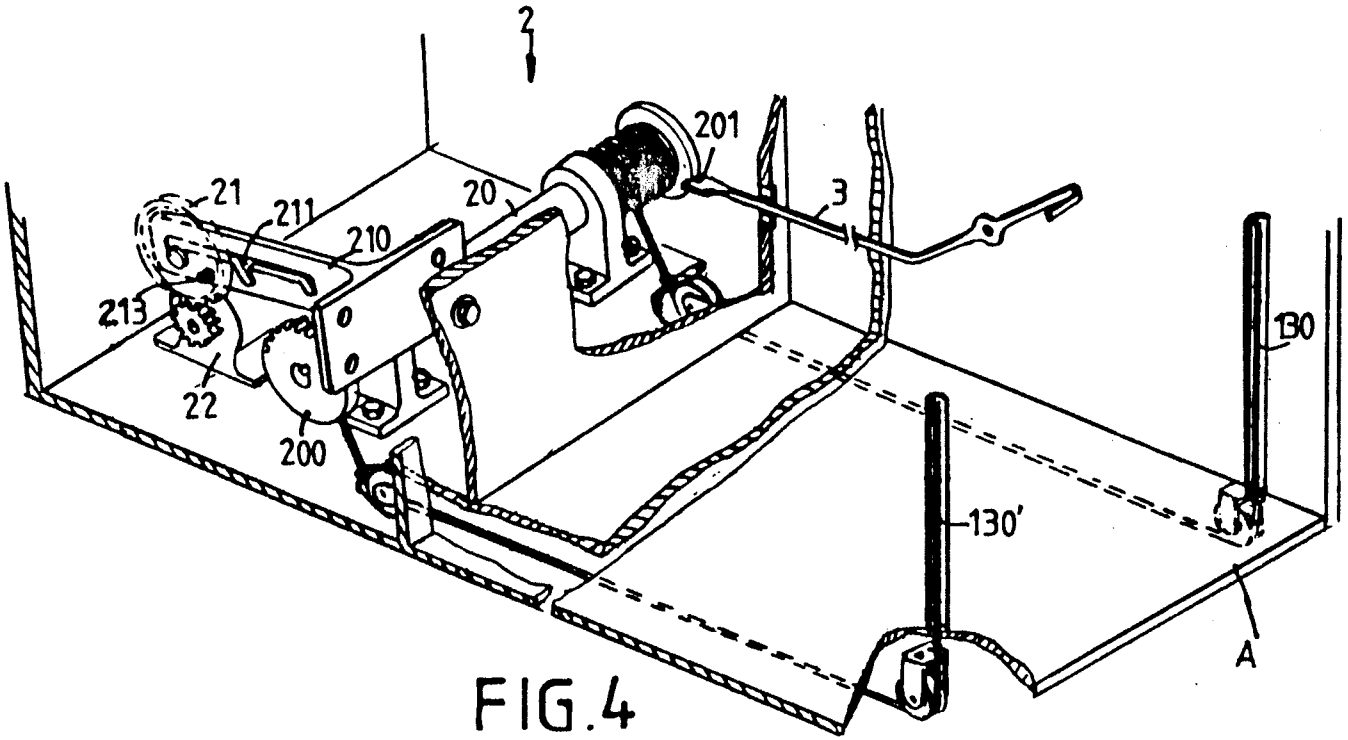
FIG. 4 is a partial, perspective view of the rewinding mechanism of the present invention.
Figure 5:
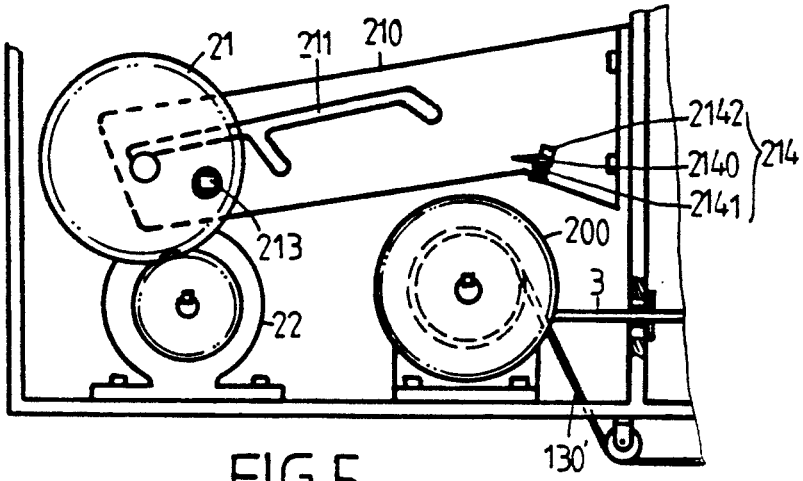
FIG. 5 is a partial side view of the rewinding mechanism of the present invention.
Figure 6:
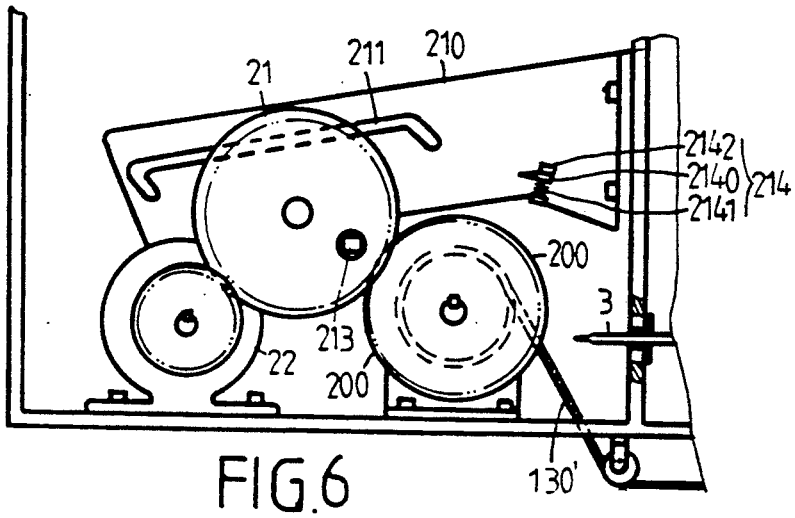
FIG. 6 is a partial side view illustrating how the movable ladder is rewound and folded up electrically by the rewinding mechanism of the present invention.
Figure 7:
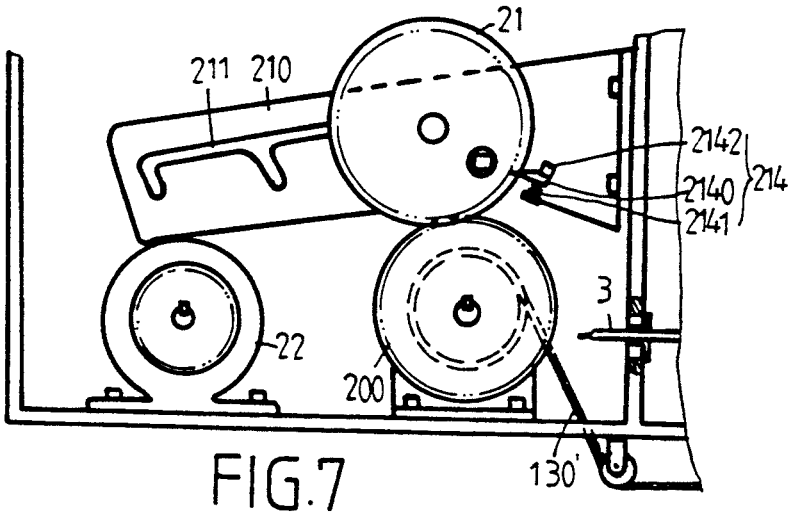
FIG. 7 is a partial side view illustrating how the movable ladder is rewound and folded up manually by the rewinding mechanism of the present invention.

The present invention relates to an "Auto Life-saving Ladder", which serves as a means of escape for people in case of fire. As illustrated in FIGS. 2–8, it comprises of a movable ladder 1, a rewinding mechanism 2 and a safety bar 3. Movable ladder 1 is a ladder which can be folded and unfolded. It is fixed to one end of the 1st railing levers 10 and 10' set beforehand in front of the aperture of the veranda which serves as an exit in front of the aperture of an existing veranda. Guardboards 11 and footboards 12 are set on the guardrailing levers. As the last footboard 12 will have to be used as a guard-railing of the exit veranda, its length should be longer than that of the other footboards. Steel wires 130, 130' are tied to each of the horizontal connecting levers 13, 13' and wound around sliding wheels 100, 100' which are set beforehand on the top end of the 1st railing levers 10, 10', and further pass through the two sliding wheels until it is wound around the rewinding mechanism 2, which comprises a rewinding wheel 20, an idle wheel 21 and a speed reducing motor 22, and which is set on the outer edge of the exit veranda or any place which is appropriate without causing obstacles to people while walking. Rewinding wheel 20 is designed for winding and fixing steel wires 130, 130' and has a coupled gear 200 set at one end. And idle wheel 21 is set on fixed plate 210 in the upper direction of coupled gear 200. By means of sliding hole 211 in fixed plate 210, idle wheel 21 is enabled to move and adjust its position within sliding hole 211. When idle wheel 21 is moved to a space in between speed reducing motor 22 and coupled gear 200, it will function as a middle wheel for speed reduced motor 22 and coupled gear 200. As indicated in FIG. 6, the movable ladder 1 which is unfolded may be electrically folded up. When idle wheel 21 is moved into direct engagement with coupled gear 200, a crank handle may be used to rotate idle wheel 21 to achieve the object of manually folding up the movable ladder. The mechanism includes a single-direction ratchet claw 214 which comprises ratchet claw 2140, a compressor spring 2141 and a fixing block 2142 set at fixed plate 210, to which idle wheel 21 is moved to enable idle wheel 21 to get in touch with single-direction ratchet claw 214 as indicated by FIG. 7 at the same time while it is moved to that position to be in direct engagement with coupled gear 200. Therefore, when idle wheel 21 is being rotated in a clockwise direction, the movable ladder 1 can be folded up. On the contrary, when idle wheel 21 is being rotated in an anticlockwise direction, no movement can be made because the single-direction ratchet claw 214 only allows idle wheel 21 to rotate in a clockwise direction. By means of such a design, the movable ladder 1 which is being folded can be fixed without unfolding by itself by its gravity. This also saves the trouble to fold the movable ladder 1 in one breath when such folding is done manually. When movable ladder 1 is folded up in front of the aperture, safety bar 3 which is set on the interior wall of the exit veranda is engaged into circular wheel aperture 201 at the other end of rewinding wheel 20. By means of the gravity of movable ladder 1, rewinding wheel 20 will be produce a clockwise torque force, so as to further enable circular wheel aperture 201 to get a firm hold on safety bar 3, so as to achieve the object of fixing movable ladder 1. At this time, idle wheel 21 is moved within sliding hole 211 to direct engagement with reduced motor 22 as shown in FIGS. 4 and 5.

Figure 11:
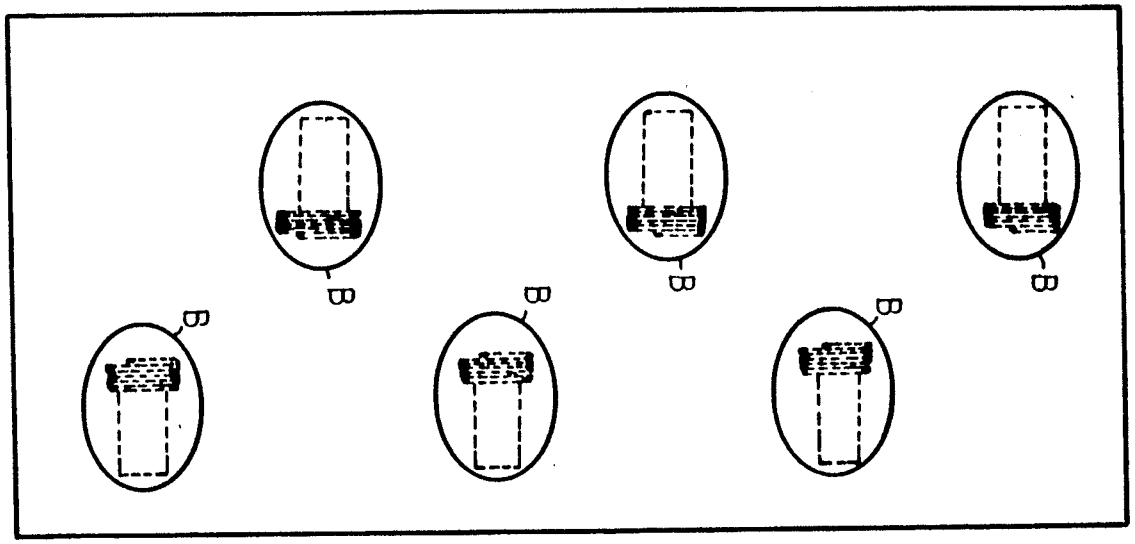
FIG. 11 is a side elevational view illustrating a seven-storied building having a decorative face-plate on the exterior wall of the veranda which serves as a fire-exit.
Figure 1:
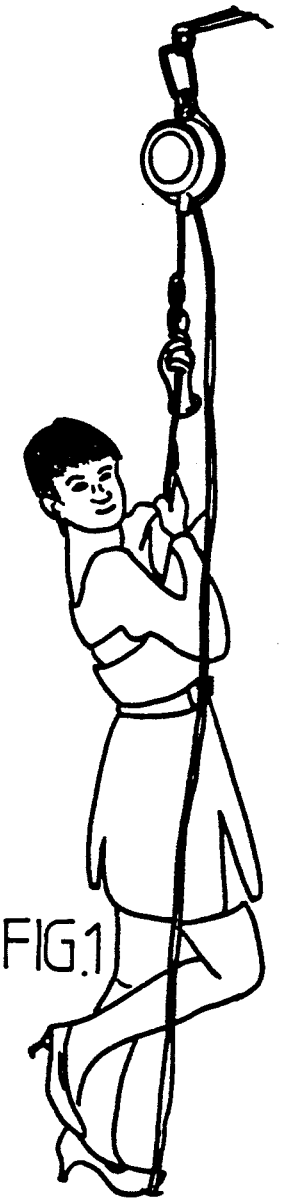
FIG.1 PRIOR ART
FIG. 1 is a pictorial view of a conventional suspension type slow descending life-saving equipment.
Figure 2:
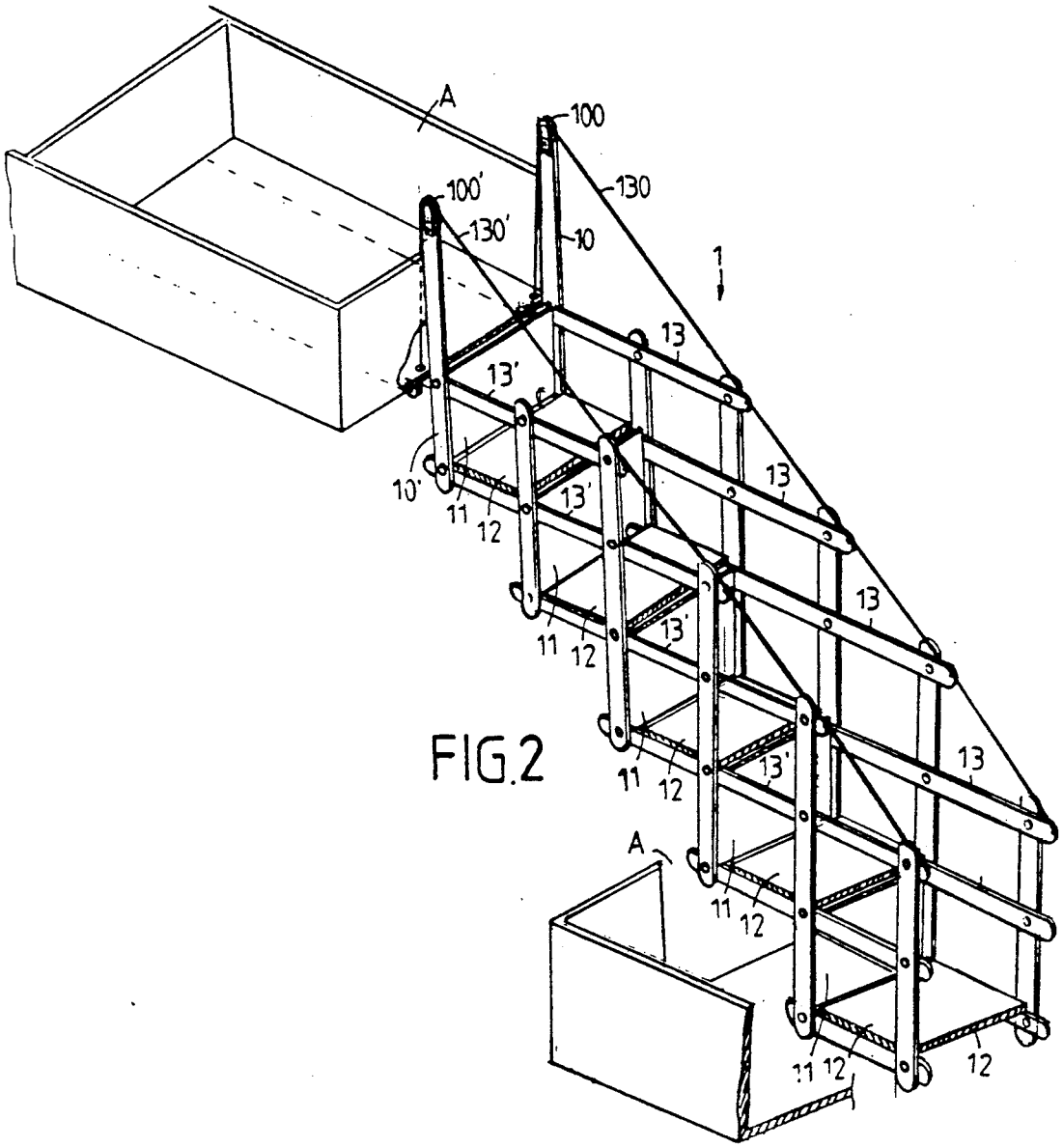
FIG. 2 is a perspective view of the present invention when being operated.
Figure 8:
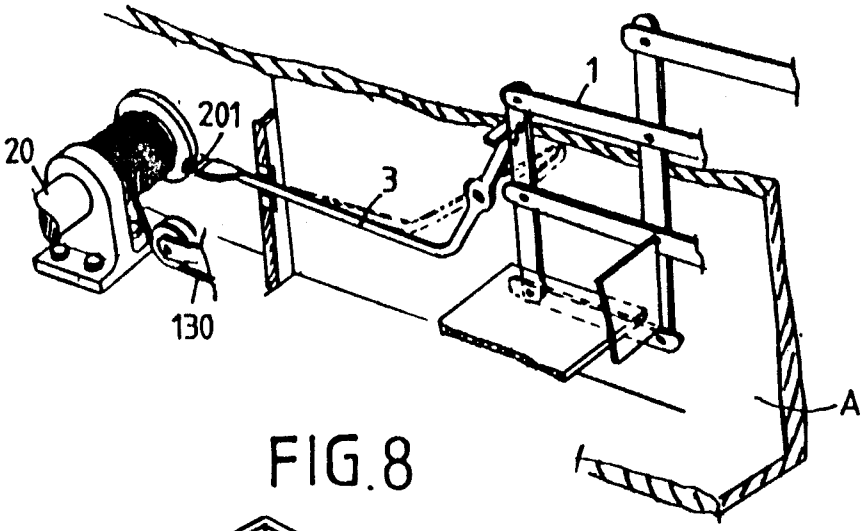
FIG. 8 is a partial perspective view illustrating how the safety bar is being pushed aside by the movable ladder of the present invention.
Figure 3:
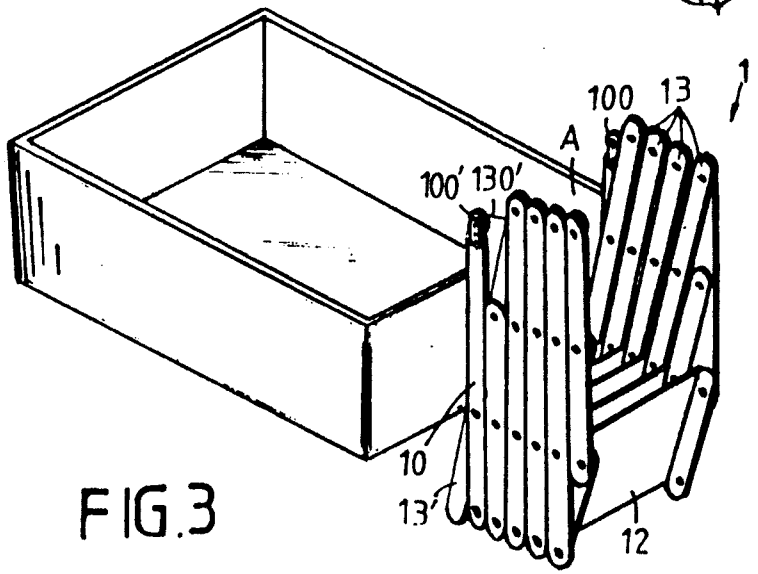
FIG. 3 is a perspective view of the movable staircase of the present invention when folded.
Figure 10:
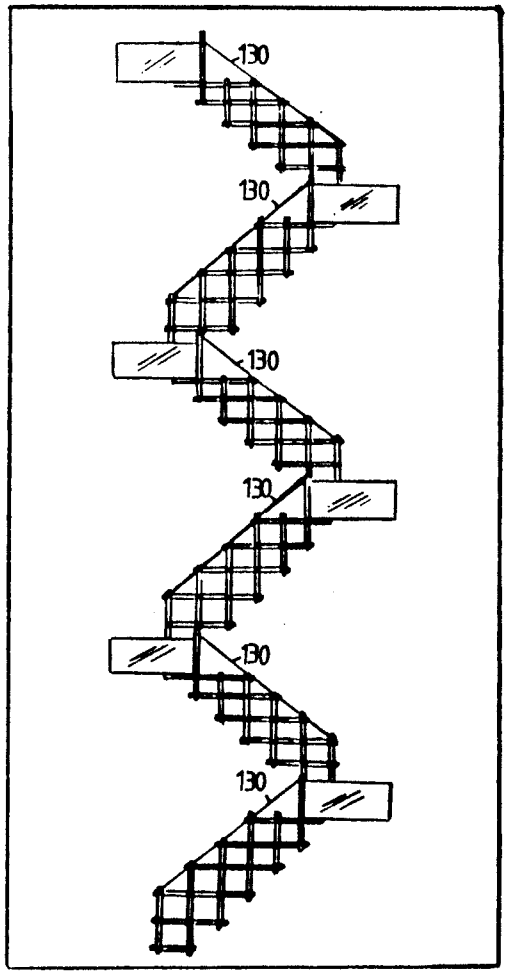
FIG. 10 is a side elevational view illustrating the installation and operation of the present invention in a seven-storied building.
Figure 9:
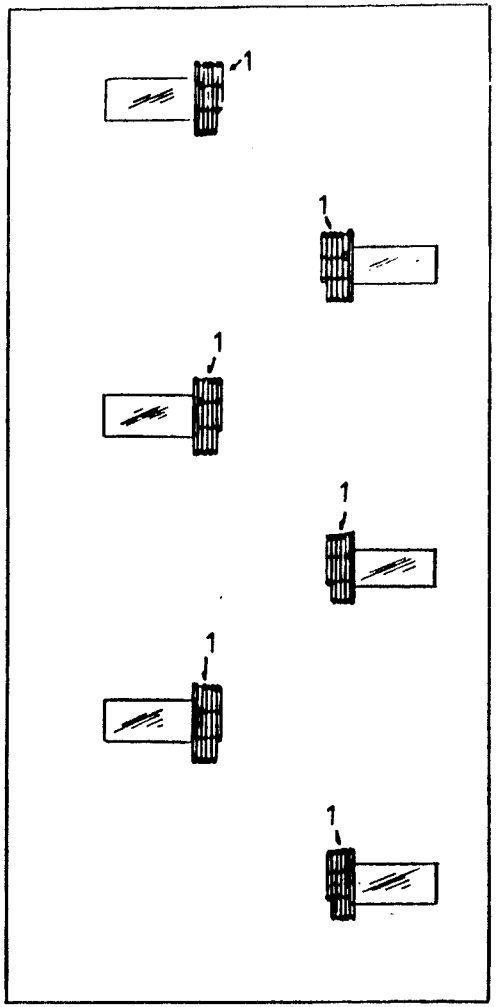
FIG. 9 is a side elevational view illustrating the installation of the present invention in a seven-storied building.

Please also refer to FIGS. 4–10, of which a seven-storied building shown in FIGS. 9–11 is used as an example indicating the installation of the present invention as well as its operation under either normal times or an emergency. According to actual requirements, the present invention may be set either in front of the aperture of an existing veranda or in front of the aperture of an exit veranda which is set beforehand on the exterior wall, or set a safety door on any selected floor level or at a place proximate to the exit veranda. On normal times, the safety door should be entirely closed. Viewing from the outside, all the exit veranda on the outer wall of a building are arranged irregularly in two rows as shown in FIG. 9; in addition, in order to make the building look nice and prevent the people within the building from looking directly outside, a decorative plate may be set at the outer edge of the exterior wall of each exit veranda as shown in FIG. 11. The said decorative plate may have different designs to match the requirements of different buildings, and will be used to cover up the entire movable ladder and the exit veranda. Viewing from the outside, only the shape of said decorative board can be seen as shown in FIG. 11. In this way, it will not only prevent theft, but will also make the exit veranda match the feature found in the outer shape and color of the building. Moreover, in case of emergency the residents may run to any floor level where there is a safety door, which they may open and rush to the exit veranda or to the exit veranda on the top floor. Then all they have to do is push the safety bar 3 aside such that the extreme end of safety bar 3 is entirely free from the grasp of wheel aperture 201 such that ladder 1 will drop and unfold downwardly by its own gravity until the extreme end of the 1st horizontal connecting lever 13, 13' contacts the bottom side of the exit veranda. The movable ladder 1 thus unfolded will become more steady without swaying. And also by means of the impulsive force which movable ladder 1 drops downward by its own gravity toward the exit veranda at a lower floor level it will cause the safety bar 3 at the lower floor level to be automatically pushed aside to enable its extreme end to be entirely free from the grasp of circular wheel aperture 201 of rewinding wheel 20 to enable the movable ladder 1 of said floor level to drop and unfold toward another lower floor level exit veranda to further push aside the safety bar 3 thereof. In this way, the same process will proceed floor by floor until all the floors at a lower level than where the residents are staying are connected automatically in a series as shown in FIG. 10, to the ultimate effect of providing a movable life-saving ladder which is safe, convenient, designed to have a high capacity and can be easily operated.

I claim:

1. An auto safety escape system which serves as a means of escape from a building in case of fire, having a plurality of escape ladders each comprising a movable ladder, a rewinding mechanism and a safety bar which are located adjacent to an aperture of an exit veranda on an exterior wall of the building, in which the movable ladder can be folded and unfolded, and comprises a plurality of laterally spaced guard-railings in front of the aperture of the exit veranda, guardboards and footboards extending between laterally spaced guardrailings to serve as a means of connecting the guardrailings and also serving as a staircase when the movable ladder is unfolded in case of emergency; the rewinding mechanism comprises a rewinding wheel on which is wound a steel wire connecting a plurality of guardrailings, an idle wheel and a speed reducing motor, the idle wheel movably located within a sliding hole defined by a fixed plate with its position adjustable within the aforesaid sliding hole between a position operatively engaging the speed reducing motor, a position operatively engaging the speed reducing motor and the rewinding wheel, so as to enable the rewinding and folding the movable ladder by the speed reducing motor and a position operatively engaging only the rewinding wheel, so as to enable the manual folding of the movable ladder an end of a safety bar engaging the rewinding wheel, so as to fix the movable ladder in a folded position, means mounting the safety bar such that it is disengageable from the rewinding wheel thereby enabling the movable ladder to drop downward and unfold itself by force of gravity until it reaches a next, escape ladder on a lower floor level the unfolding ladder causing the disengagement of the safety bar of the lower escape ladder so as to enable the movable ladder of that floor level to also drop downwardly and unfold itself under the force of gravity whereby this movement is repeated floor after floor until all ladders below the initial ladder are unfolded.

2. The auto safety escape system as claimed in claim 1, wherein the steel wire is connected to tops of the guard railings and further comprising a sliding wheel attached to a guard railing such that the steel wire passes over the sliding wheel until it reaches and is wound round the rewinding wheel thereby enabling the steel wire to serve as a handrail on the guard-railings when the safety ladder is unfolded, and as the medium through which the movable ladder is rewound by the rewinding mechanism.

3. The auto safety escape system of claim 1, further comprising a last footboard located at a distal end of the movable ladder and having a length greater than the other footboards.

4. The safety escape system of claim 1, further comprising a ratchet mechanism located on the fixed plate so as to be operatively engageable with the idle wheel when the idle wheel is in a position engaging only the rewinding wheel so that when the movable ladder is being folded manually, the idle wheel can only rotate in one direction, to thus facilitate the manual folding operation of the movable ladder.

* * * * *